US009599919B2

(12) United States Patent
Isono et al.

(10) Patent No.: US 9,599,919 B2
(45) Date of Patent: Mar. 21, 2017

(54) TONER

(71) Applicant: CANON KABUSHIKI KAISHA, Tokyo (JP)

(72) Inventors: Naoya Isono, Suntou-gun (JP); Masatake Tanaka, Yokohama (JP); Tsutomu Shimano, Mishima (JP); Shintaro Noji, Mishima (JP); Yu Yoshida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/555,525

(22) Filed: Nov. 26, 2014

(65) Prior Publication Data

US 2015/0153666 A1 Jun. 4, 2015

(30) Foreign Application Priority Data

Nov. 29, 2013 (JP) ..... 2013-247684

(51) Int. Cl.
*G03G 9/087* (2006.01)
*G03G 9/08* (2006.01)

(52) U.S. Cl.
CPC ..... *G03G 9/08711* (2013.01); *G03G 9/0804* (2013.01); *G03G 9/08755* (2013.01); *G03G 9/08788* (2013.01); *G03G 9/08795* (2013.01); *G03G 9/08797* (2013.01)

(58) Field of Classification Search
CPC ..... G03G 9/08711; G03G 9/08788; G03G 9/08795; G03G 9/08797
See application file for complete search history.

(56) References Cited

U.S. PATENT DOCUMENTS 5,260,159 A * 11/1993 Ohtani ..... G03G 9/08 430/108.4
2009/0068578 A1* 3/2009 Murakami ..... G03G 9/0808 430/105
2013/0280649 A1* 10/2013 Nagasawa ..... G03G 9/09733 430/108.4

FOREIGN PATENT DOCUMENTS

JP 62-273574 A 11/1987

OTHER PUBLICATIONS

U.S. Appl. No. 14/554,802, filed Nov. 26, 2014. Inventor: Shintaro Noji.
U.S. Appl. No. 14/554,832, filed Nov. 26, 2014. Inventor: Masatake Tanaka.

* cited by examiner

*Primary Examiner* — Peter Vajda
(74) *Attorney, Agent, or Firm* — Fitzpatrick, Cella, Harper & Scinto

(57) ABSTRACT

The present invention relates to a toner having a toner particle containing a binder resin containing a styrene acrylic resin and a block polymer, wherein the block polymer has a polyester segment and a vinyl polymer segment and has a melting point of 55° C. to 90° C., the polyester segment has a specific structure and a solubility parameter (SP) value of 9.40 to 9.85, and the vinyl polymer segment has a weight-average molecular weight (Mw) of 4000 to 15000.

14 Claims, No Drawings

TONER

BACKGROUND OF THE INVENTION

Field of the Invention

The present invention relates to a toner used in an image-forming method in the manner of electrophotography, electrostatic recording and toner jet printing.

Description of the Related Art

Image-forming methods used to develop electrostatic latent images are applied to photocopiers, multifunction copiers, and printers. These image-forming methods typically include forming an electrostatic latent image on a photosensitive member followed by forming a toner image by developing the electrostatic latent image using toner, transferring the toner image to a transfer material in the manner of paper and then fixing the toner image on the transfer material by a fixing method using heat and pressure to obtain a fixed image.

Various methods have been developed for fixing a toner image to a transfer material in the manner of paper. Examples of such methods include a heated roller fixing method whereby a toner image is fixed to a transfer material by heated rollers and pressure rollers, and a film fixing method whereby a pressure member is adhered to a heating unit through a film followed by fixing a toner image to a transfer material.

These fixing methods have favorable thermal efficiency during melt adhesion of a toner image to a transfer material since contact is made between the heated rollers, film surface and toner image on the transfer material, thereby enabling fixation to be carried out rapidly. Consequently, these fixing methods are widely used in multifunction copiers and printers.

Image-forming apparatuses are being strongly required to save energy. One example of an effective means for reducing the energy consumed by image-forming apparatuses is to lower the set temperatures of the heated rollers, film and other fixing members. In order to accomplish this, however, the low-temperature fixability of the toner used has to be further improved. One method that has been proposed for improving the low-temperature fixability of toner includes further lowering the softening point of the toner by using a crystalline resin. As a result of adopting these countermeasures, it has become possible to utilize the sharp melt property attributable to crystalline resin which allows the softening temperature of the toner to be set to a lower temperature, thereby making it possible to improve low-temperature fixability.

However, the above-mentioned toner is susceptible to the occurrence of offset phenomenon in which a portion of the toner (and particularly crystalline resin having low viscosity) ends up adhering to the surfaces of these fixing members and toner adhered to the heated rollers or film ends up re-transferring to the next transfer material. In response to this problem, the use of crystalline and amorphous block resins as binder resins has been proposed (see Japanese Patent Application Laid-open No. S62-273574). As a result of implementing these countermeasures, offset to fixing members decreases and a toner can be obtained that has stable fixing performance over a wide temperature range.

However, at present, with the growing proliferation of multifunction copiers and fax machines and printers and their use in various regions and environments, new problems have arisen involving the occurrence of image defects as a result of being unable to obtain favorable charging characteristics when conventional toner is used under more diverse conditions.

In addition, as the functions of multifunction copiers and printers have become increasingly sophisticated, in multifunction copiers and printers that require continuous and high-speed printing over a long period of time, in a case where continuous printing is carried out using conventional toner, the toner ended up melt-adhering to the developing device as a result of being unable to obtain adequate durability, and this ended up causing the occurrence of image defects.

Consequently, there is a need for a toner that demonstrates superior low-temperature fixability and allows the formation of favorable toner images over a long period of time while maintaining a wide fixable range.

SUMMARY OF THE INVENTION

An object of the present invention is to provide a toner that demonstrates superior low-temperature fixability and is capable of forming favorable toner images over a long period of time while maintaining a wide fixation temperature range.

The present invention provides a toner having a toner particle containing a binder resin containing a styrene acrylic resin and a block polymer, wherein the block polymer has a polyester segment and a vinyl polymer segment, the melting point (Tm) of the block polymer is 55° C. to 90° C., the polyester segment has at least two structures selected from structures represented by the following formulas (1) to (3) or a structure represented by the following formula (3), the solubility parameter (SP) value of the polyester segment is 9.40 to 9.85, and the weight-average molecular weight (Mw) of the vinyl polymer segment is 4,000 to 15,000:

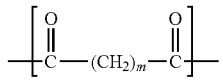

(1)

(where, m represents an integer of 6 to 14), (2)

(where, n represents an integer of 6 to 16), and

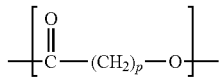

(3)

(where, p represents an integer of 5 to 15).

According to the present invention, a toner can be provided that demonstrates superior low-temperature fixability, maintains a wide fixation temperature range, and demonstrates superior durability and charging performance.

Further features of the present invention will become apparent from the following description of exemplary embodiments.

DESCRIPTION OF THE EMBODIMENTS

The following provides a detailed explanation of embodiments of the present invention.

The toner of the present invention is a toner that has a toner particle containing a binder resin that contains a styrene acrylic resin and a block polymer, wherein the block polymer has a polyester segment and a vinyl polymer segment, the melting point of the block polymer is 55° C. to 90° C., the polyester segment has at least two structures selected from the structures represented by the following formulas (1) to (3) (units shown in formulas (1) to (3)) or a structure represented by the following formula (3), the solubility parameter (SP) value of the polyester segment is 9.40 to 9.85, and the weight-average molecular weight (Mw) of the vinyl polymer segment is 4,000 to 15,000.

Preferably, the above-mentioned polyester segment has a structure represented by formula (1) and a structure represented by formula (2).

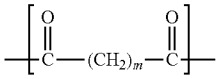

(1)

(In formula (1), m represents an integer of 6 to 14.)

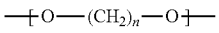

(2)

(In formula (2), n represents an integer of 6 to 16.)

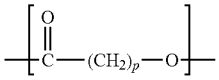

(3)

(In formula (3), p represents an integer of 5 to 15.)

The inventors of the present invention found that by using a specific block polymer as a second binder resin in toner particles having a styrene acrylic resin as a binder resin, a toner is obtained that demonstrates superior low-temperature fixability, maintains a wide fixation temperature range, and demonstrates superior durability and charging performance.

More specifically, since the block polymer used in the present invention is a crystalline resin, it typically has low elasticity and inferior mechanical strength. Consequently, in the case of using alone as a binder resin, it is difficult to obtain adequate durability resulting in increased susceptibility to the occurrence of streaks and other image defects. In addition, since crystal segments of the resin function as charge leakage sites, charging performance is extremely inferior resulting in increased susceptibility to the occurrence of fogging and other problems. In the present invention, the combined use of a styrene acrylic resin and a block polymer having a specific configuration and solubility parameter (SP) value for the binder resin was found to enable the above-mentioned problems to be solved while maintaining low-temperature fixability and fixing region width. Use of the above-mentioned block polymer enables the styrene acrylic resin and block polymer to adopt a phase-separated structure in the toner. As a result, toughness of the styrene acrylic resin is maintained and enhanced durability is obtained. In addition, the polyester segment (crystal segment) of the block polymer capable of becoming a charge leakage site does not appear on the surface, thereby allowing the obtaining of favorable images that demonstrate superior charging characteristics and exhibit little fogging even in high-temperature, high-humidity environments over a long period of time.

On the other hand, when heat is supplied to the toner in the fixation process, the block polymer is instantly compatible with the styrene acrylic resin, with the vinyl polymer segment being a starting point of compatibilization and demonstrates a plasticizing effect. As a result, the softening point of the toner lowers and low-temperature fixability is achieved. In addition, since the block polymer per se has a vinyl polymer segment, it functions as a binder resin after melting as a result of having suitable viscosity required for fixation, and low-temperature fixability is achieved synergistically. Moreover, since the toner of the present invention has a styrene acrylic resin as a main binder resin, viscosity of the toner after melting is maintained, thereby enabling fixation over a wide temperature range.

In the case the solubility parameter (SP) value of the polyester segment of the block polymer is less than 9.40, it becomes difficult for the block polymer to be compatible with the styrene acrylic resin during melting due to the relationship with the SP value of the styrene acrylic resin, thereby making it difficult to obtain low-temperature fixability. Conversely, if the SP value is greater than 9.85, the styrene acrylic resin and block polymer end up compatibilizing together even in the state of a toner, thereby causing the styrene acrylic resin to lose its toughness and resulting in a decrease in durability. In addition, if the block copolymer and styrene acrylic resin are in a compatible state, a large number of charge leakage sites are present on the toner surface resulting in increased susceptibility to fogging. The SP value is more preferably 9.50 to 9.75.

The SP value can be controlled according to the type and amount of monomer added. In order to increase the SP value, a monomer having a high SP value, for example, is added. On the other hand, in order to decrease the SP value, a monomer having a low SP value, for example, is added.

The polyester segment of the block polymer can be formed from a dicarboxylic acid, as represented by the following formula (A), an alkyl ester compound or an acid anhydride thereof, and a diol, as represented by the following formula (B). The polyester segment is formed by condensation polymerization thereof.

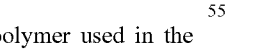

$$HOOC—(CH_2)_m—COOH \quad (A)$$

(In the formula, m represents an integer of 6 to 14 (and preferably 6 to 10).)

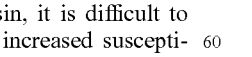

$$HO—(CH_2)_n—OH \quad (B)$$

(In the formula, n represents an integer of 6 to 16 (and preferably 6 to 12).)

A compound in which a carboxyl group is converted to an alkyl (preferably having 1 to 4 carbon atoms) ester or an acid anhydride may be used for the dicarboxylic acid, provided the same partial backbone is formed in the polyester segment.

The use of the above-mentioned polyester segment makes it possible to obtain desired values for SP value and melting point.

Preferable examples of dicarboxylic acids include suberic acid, sebacic acid, dodecanedioic acid and tetradecanedioic acid.

Preferable examples of diols include 1,5-pentanediol, 1,6-hexanediol, 1,7-heptanediol, 1,9-nonanediol, 1,10-decanediol and 1,12-dodecanediol.

In addition, a monohydroxy monocarboxylic acid having 6 to 16 carbon atoms can be used to form the polyester segment. The use of a monohydroxy monocarboxylic acid enables the polyester segment to have a structure represented by formula (3).

Examples of monohydroxy monocarboxylic acids include 6-hydroxyhexanoic acid, 7-hydroxyheptanoic acid, 8-hydroxyoctanoic acid, 9-hydroxynonanoic acid, 10-hydroxydecanoic acid, 11-hydroxyundecanoic acid, 12-hydroxydodecanoic acid, 13-hydroxytridecanoic acid and 14-hydroxytetradecanoic acid. These monohydroxy monocarboxylic acids may also be used in the reaction in the form of a lactone or alkyl ester.

A known vinyl monomer in the manner of styrene, methyl methacrylate or n-butyl acrylate can be used for the composition of the vinyl polymer segment of the block polymer. Styrene is particularly preferable since it functions effectively as a compatible segment with the styrene acrylic resin, resulting in the further demonstration of plasticity during melting.

The weight-average molecular weight (Mw) of the vinyl polymer segment is required to be 4,000 to 15,000. In the case it is less than 4,000, low-temperature fixability ends up being inferior since it becomes difficult to function as a compatibilizing starting point with the styrene acrylic resin. Moreover, heat resistance and durability are impaired as a result of the performance of the vinyl polymer segment not being demonstrated. If the weight-average molecular weight (Mw) exceeds 15,000, the physical properties of the vinyl polymer segment become excessively prominent, the sharp melt property attributable to the polyester segment is impaired, and the effect of low-temperature fixability is not obtained. The weight-average molecular weight (Mw) is preferably 4500 to 12500 and more preferably 5,000 to 10,000.

The ratio (Mw/Mn) of the weight-average molecular weight (Mw) to the number average molecular weight (Mn) of the vinyl polymer segment is preferably 1.3 to 3.5 and more preferably 1.5 to 3.0. If the ratio Mw/Mn is 1.3 or more, the block polymer has a wide fixing region due to the broad distribution of molecular weight. If the ratio Mw/Mn is 3.5 or less, there is little variation in molecular weight and less susceptibility to the occurrence of decreases in heat resistance and durability caused by low molecular weight components as well as decreases in gloss caused by high molecular weight components.

Weight-average molecular weight (Mw) and number average molecular weight (Mn) can be controlled according to such factors as the amount of initiator, timing of addition and reaction temperature.

The melting point (Tm) of the block polymer is required to be 55° C. to 90° C. In the case the melting point (Tm) is lower than 55° C., blocking occurs easily making the block polymer difficult to use from the viewpoint of storability. In the case the melting point (Tm) is higher than 90° C., since the temperature required to melt the block polymer becomes high, the block polymer is difficult to use from the viewpoint of low-temperature fixability. The melting point (Tm) of the block polymer is preferably 60° C. to 85° C.

The melting point of the block polymer can be controlled according to the monomer that forms the polyester segment and the ratio between the polyester segment and the vinyl polymer segment.

The content of the block polymer in the binder resin is preferably within the range of 2.0% by mass to 50.0% by mass and more preferably within the range of 6.0% by mass to 50.0% by mass. If the content is 2.0% by mass or more (and preferably 6.0% by mass or more), it becomes easier to obtain the effects of the present invention in the form of a plasticizing effect during melting and a binding effect attributable to the block polymer, thereby improving low-temperature fixability. If the content is 50.0% by mass or less, it becomes difficult for charge leakage to occur from the crystalline polyester segment and there is less susceptibility to the occurrence of a decrease in charging performance and the occurrence of fogging. In addition, since it is also difficult for a decrease in stress resistance to occur, there is less susceptibility to the occurrence of a decrease in durability and the occurrence of image defects such as development streaks. The content of the block polymer is more preferably 10.0% by mass to 45.0% by mass and even more preferably 20.0% by mass to 40.0% by mass.

The mass-based ratio (C/A) of the polyester segment to the vinyl polymer segment of the block polymer is preferably within the range of 40:60 to 80:20 and more preferably within the range of 40:60 to 70:30. If the ratio if 40:60 or more, the characteristics of the polyester segment increase and the sharp melt property is adequate, thereby resulting in superior low-temperature fixability. If the ratio is 80:20 or less (and preferably 70:30 or less), the characteristics of the polyester segment are not excessively prominent and there is less susceptibility to the occurrence of exacerbation of heat resistance and the occurrence of blocking. The ratio (C/A) is even more preferably 45:55 to 60:40.

The weight-average molecular weight (Mw) of the block polymer is preferably 15,000 to 45,000 and more preferably 20,000 to 45,000. In addition, the ratio (Mw/Mn) of the weight-average molecular weight (Mw) to the number average molecular weight (Mn) of the block polymer is preferably 1.5 to 3.5. If the weight-average molecular weight is 15,000 or more (and preferably 20,000 or more), the block polymer demonstrates superior mechanical strength and high durability. If the weight-average molecular weight is 45,000 or less, there is less likelihood of the movement of molecules becoming slow, thereby facilitating the obtaining of plasticizing effects during melting. The weight-average molecular weight is more preferably 23,000 to 40,000 and even more preferably 25,000 to 37,000.

The ratio (Mw/Mn) of the weight-average molecular weight (Mw) to the number average molecular weight (Mn) of the block polymer is preferably 1.5 to 3.5 and more preferably 1.6 to 3.0. Similar to the case of the vinyl polymer segment, if the ratio (Mw/Mn) is 1.5 or more, the block polymer has a wide fixing region due to the broad distribution of molecular weight. If the ratio Mw/Mn is 3.5 or less, there is a lower level of variation in molecular weight and less susceptibility to the occurrence of decreases in heat resistance and durability caused by low molecular weight components as well as decreases in gloss caused by high molecular weight components.

Furthermore, a block polymer is defined as a polymer composed of a plurality of linearly linked blocks (Society of Polymer Science, Glossary of Basic Terms in Polymer Science, IUPAC Commission on Macromolecular Nomenclature), and the present invention is in accordance with that definition.

A vinyl-based polymerizable monomer capable of undergoing radical polymerization can be used for the polymerizable monomer that forms the styrene acrylic resin. A monofunctional polymerizable monomer or polyfunctional polymerizable monomer can be used for the vinyl-based polymerizable monomer.

Examples of the above-mentioned monofunctional polymerizable monomer include styrene and styrene derivatives in the manner of α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene;

acrylic-based polymerizable monomers in the manner of methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate; and, methacrylic-based polymerizable monomers in the manner of methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate.

Examples of polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butyleneglycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane 2,2'-bis(4-(methacryloxypolyethoxy)phenyl)propane, trimethylolpropane trimethacrylate, tetramethylolmethane tetramethacrylate, divinylbenzene, divinylnaphthalin and divinyl ether.

The monofunctional polymerizable monomer is used alone, or used in a combination of two or more types thereof, or used in a combination of a monofunctional polymerizable monomer and polyfunctional polymerizable monomer, or the polyfunctional polymerizable monomer is used alone or used in a combination of two or more types thereof. Among polymerizable monomers, the use of styrene or a styrene derivative either alone or as a mixture, or by mixing with another polymerizable monomer, is preferable from the viewpoint of toner developing characteristics and durability.

The SP value of the styrene acrylic resin is preferably 9.45 to 9.90 and more preferably 9.50 to 9.85. The absolute value (ΔSP value) of the difference between the SP value of the styrene acrylic resin and the SP value of the block polymer is preferably 0.03 to 0.20 and more preferably 0.05 to 0.16. As a result of being within these ranges, it becomes easier to obtain balance between the phase separated state where a toner form is maintained and the compatible state during melting.

Although the method used to produce toner particles according to the present invention may be any production method, the toner is preferably obtained by a production method in which a polymerizable monomer composition is granulated in an aqueous medium as represented by a suspension polymerization method, an emulsion polymerization method and a suspension granulation method.

The following provides an explanation of a method for producing toner particles that uses the suspension polymerization method, which is the most preferable method for producing toner particles used in the present invention.

The above-mentioned polymerizable monomer that forms the styrene acrylic resin, a specific block polymer and, as necessary, other additives such as colorant or wax are uniformly dissolved or dispersed by a disperser, such as a homogenizer, ball mill, colloid mill or ultrasonic disperser, followed by dissolving a polymerization initiator therein to prepare a polymerizable monomer composition. Next, the polymerizable monomer composition is suspended in an aqueous medium containing a dispersion stabilizer and polymerized to produce toner particles.

The polymerization initiator may be added simultaneously when adding other additives to the polymerizable monomer, or may be mixed immediately prior to suspending in the aqueous medium. In addition, a polymerization initiator dissolved in the polymerizable monomer or solvent may be added prior to the start of the polymerization reaction immediately after granulation.

In the case of a polymerization method that uses an aqueous medium as represented by a suspension polymerization method, a polar resin is preferably added to the above-mentioned mixed liquid. The addition of a polar resin makes it possible to promote encapsulation of the block polymer and wax.

In the case a polar resin is present in a polymerizable monomer composition suspended in an aqueous medium, since the polar resin easily migrates to the vicinity of the interface between the aqueous medium and polymerizable monomer composition due to differences in their affinity to water, the polar resin is unevenly distributed on the surface of the toner particles. As a result, the toner particles have a core-shell structure.

In addition, if a polar resin having a high melting temperature is selected for the polar resin used for the shell, the occurrence of blocking during toner storage can be inhibited even in the case of having designed the binder resin to melt at a lower temperature for the purpose of low-temperature fixability.

A polyester-based resin or carboxyl group-containing styrene-based resin is preferable for the polar resin. The use of a polystyrene-based resin or carboxyl group-containing styrene-based resin for the polar resin makes it possible to anticipate lubricity from the resin per se when having formed a shell by unevenly distributing the resin on the surface of toner particles.

A resin obtained by condensation polymerization of an acid component monomer and alcohol component monomer, examples of which are indicated below, can be used for the polyester-based resin. Examples of acid component monomers include terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexane dicarboxylic acid and trimellitic acid.

Examples of alcohol component monomers include ethylene glycol, diethylene glycol, triethylene glycol, 1,2-propylene glycol, 1,3-propylene glycol, 1,4-butanediol, neopentyl glycol, alkylene glycols and polyalkylene glycols of 1,4-bis(hydroxymethyl)cyclohexane, bisphenol A, hydrogenated bisphenol, ethylene oxide adducts of bisphenol A, propylene oxide adducts of bisphenol A, glycerin, trimethylolpropane and pentaerythritol.

A styrene-based acrylic acid copolymer, styrene-based methacrylic acid copolymer or styrene-based maleic acid copolymer and the like is preferable for the carboxyl group-containing styrene-based resin, while a styrene-acrylic acid ester-acrylic acid-based copolymer is particularly preferable since it facilitates control of the amount of electric charge.

In addition, the carboxyl group-containing styrene-based resin more preferably contains a monomer having a primary or secondary hydroxyl group. Specific examples of polymer compositions include a styrene-2-hydroxyethyl methacrylate-methacrylic acid-methyl methacrylate copolymer, styrene-n-butyl acrylate-2-hydroxyethyl methacrylate-methacrylic acid-methyl methacrylate copolymer, and styrene-α-methylstyrene-2-hydroxyethyl methacrylate-methacrylic acid-methyl methacrylate copolymer. Resins containing a monomer having a primary or secondary hydroxyl group have a high level of polarity and demonstrate more favorable long-term standing stability.

The content of the polar resin is preferably 1.0 part by mass to 20.0 parts by mass, and more preferably 2.0 parts by mass to 10.0 parts by mass, based on 100.0 parts by mass of the binder resin (styrene acrylic resin (or polymerizable monomer that forms the styrene acrylic resin) and block polymer).

A known wax component may be used for the wax in the present invention. Specific examples thereof include petroleum-based waxes and derivatives thereof as represented by paraffin wax, microcrystalline wax and petrolatum, montan wax and derivatives thereof, hydrocarbon waxes obtained by the Fischer-Tropsch method and derivatives thereof, polyolefin waxes and derivatives thereof as represented by polyethylene, and natural waxes and derivatives thereof as represented by carnauba wax and candelilla wax, and oxides, block copolymers with vinyl monomers and graft modification products are included in the above-mentioned derivatives. In addition, other examples include alcohols such as higher aliphatic alcohols, fatty acids such as stearic acid or palmitic acid and acid amides, esters and ketones thereof, hydrogenated castor oil and derivatives thereof, plant wax and animal wax. These can be used alone or in combination.

Among these, in the case of using a polyolefin, a hydrocarbon wax obtained according to the Fischer-Tropsch method or a petroleum-based wax, effects that improve developability and transferability are further enhanced. Furthermore, an antioxidant may be added to these wax components within a range that does not have an effect on charging performance of the toner. In addition, these wax components are preferably used at 1.0 part by mass to 30.0 parts by mass based on 100.0 parts by mass of the binder resin.

The melting point of the wax component used in the present invention is preferably within the range of 30° C. to 120° C. and more preferably within the range of 60° C. to 100° C.

The use of a wax component that exhibits heat characteristics as described above not only enables the resulting toner to demonstrate favorable fixing performance, but also enables the wax component to efficiently demonstrate mold release effects, thereby ensuring an adequate fixing region.

The following organic pigments, organic dyes and inorganic dyes may be used as colorants in the present invention.

Examples of cyan-based colorants include copper phthalocyanine compounds and derivatives thereof, anthraquinone compounds and basic dye lake compounds. Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

Examples of magenta-based colorants include condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Specific examples thereof include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

Examples of yellow-based colorants include condensed azo compounds, isoindolinone compounds, anthraquinone compounds, azo metal complexes, methine compounds and allylamide compounds. Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 185, C.I. Pigment Yellow 191 and C.I. Pigment Yellow 194.

Examples of black colorants include carbon black and colorants obtained by adjusting the color to black using the above-mentioned yellow-based colorants, magenta-based colorants and cyan-based colorants.

These colorants can be used alone, or used as a mixture or in the state of a solid solution. Colorants used in the present invention are selected from the viewpoints of hue angle, chroma, lightness, lightfastness, OHP transparency and dispersibility in toner particles.

The colorant is preferably used at 1.0 part by mass to 20.0 parts by mass based on 100.0 parts by mass of the binder resin.

In the case of obtaining toner particles using a suspension polymerization method, a colorant is preferably used that has been subjected to hydrophobic treatment with a substance that does not inhibit polymerization taking into consideration polymerization inhibition and aqueous phase migration of the colorant. An example of a preferable method for carrying out hydrophobic treatment on a dye includes preliminarily polymerizing a polymerizable monomer in the presence of these dyes to obtain a colored polymer, after which the resulting colored polymer is added to a polymerizable monomer composition.

In addition, carbon black may be treated with a substance that reacts with surface functional groups of the carbon black (polyorganosiloxane) in addition to subjecting to hydrophobic treatment in the same manner as the above-mentioned dye.

In addition, a charge control agent may be used as necessary. A known charge control agent can be used for the charge control agent, and a charge control agent having a rapid triboelectric charging speed that is able to stably maintain a constant triboelectric charge quantity is particularly preferable. Moreover, in the case of producing toner particles by a suspension polymerization method, a charge control agent that exhibits a lower level of inhibition of polymerization and is practically not soluble in an aqueous medium is particularly preferable.

Charge control agents are those that control toner to negative chargeability and those that control toner to positive chargeability. Examples of charge control agents that control toner to negative chargeability include monoazo metal compounds, acetylacetone metal compounds, aromatic oxycarboxylic acids, aromatic dicarboxylic acids, oxycarboxylic acid- and dicarboxylic acid-based metal compounds, aromatic oxycarboxylic acids, aromatic mono- and polycarboxylic acids and metal salts, anhydrides, esters, phenol derivatives in the manner of bisphenol and urea derivatives thereof, metal-containing salicylic acid-based compounds, metal-containing naphthoic acid-based compounds, boron compounds, quaternary ammonium salts, calixarene and charge control resins.

On the other hand, examples of charge control agents that control toner to positive chargeability include guanidine compounds, imidazole compounds, quaternary ammonium salts in the manner of tributylbenzylammonium-1-hydroxy-4-naphthosulfonate and tetrabutylammonium tetrafluoroborate, analogues thereof in the form of onium salts in the manner of phosphonium salts and lake pigments thereof, triphenylmethane dyes and lake pigments thereof (and examples of laking agents include phosphotungstic acid, phosphomolybdic acid, phosphotungstomolybdic acid, tannic acid, lauric acid, gallic acid, ferricyanide and ferrocyanide), metal salts of higher fatty acids and charge control resins.

These charge control agents may be added alone or two or more types may be added in combination.

Among these charge control agents, metal-containing salicylic acid-based compounds are preferable, and those in which the metal is aluminum or zirconium are particularly preferable.

The amount of charge control agent added is preferably 0.01 parts by mass to 20.0 parts by mass, and more preferably 0.5 parts by mass to 10.0 parts by mass, based on 100.0 parts by mass of the binder resin.

A polymer or copolymer having a sulfonic acid group, sulfonate group or sulfonic acid ester group is preferably used for the charge control resin. In particular, a polymer having a sulfonic acid group, sulfonate group or sulfonic acid ester group preferably contains 2% by mass or more, and more preferably contains 5% by mass or more, of a sulfonic acid group-containing acrylamide-based monomer or sulfonic acid group-containing methacrylamide-based monomer in terms of the copolymerization ratio. The charge control resin preferably has a glass transition temperature (Tg) of 35° C. to 90° C., a peak molecular weight (Mp) of 10,000 to 30,000 and a weight-average molecular weight (Mw) of 25,000 to 50,000. In the case of using such a charge control resin, preferable triboelectric charge characteristics can be imparted without having an effect on the thermal characteristics required by toner particles. Moreover, since the charge control resin contains a sulfonic acid group, dispersibility of the charge control resin per se in a dispersion of the colorant along with dispersibility of the colorant can be improved, while tinting strength, transparency and triboelectric charge characteristics can be further improved.

A polymerization initiator may be used to polymerize the polymerizable monomer. Examples of polymerization initiators that can be used in the present invention include organic peroxide-based initiators and azo-based polymerization initiators. Examples of organic peroxide-based initiators include benzoyl peroxide, lauroyl peroxide, di-α-cumyl peroxide, 2,5-dimethyl-2,5-bis(benzoylperoxy)hexane, bis(4-t-butylcyclohexyl)peroxy-di-carbonate, 1,1-bis(t-butylperoxy)cyclododecane, t-butylperoxymaleic acid, bis(t-butylperoxy)isophthalate, methyl ethyl ketone peroxide, tert-butylperoxy-2-ethylhexanoate, diisopropyl peroxycarbonate, cumene hydroperoxide, 2,4-dichlorobenzoyl peroxide and tert-butyl peroxypivalate.

Examples of azo-based polymerization initiators include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobismethylbutyronitrile.

In addition, a redox-based initiator combining an oxidizing substance and a reducing substance can also be used as a polymerization initiator. Examples of oxidizing substances include inorganic peroxides such as hydrogen peroxide or persulfates (including sodium salts, potassium salts and ammonium salts) and oxidizing metal salts such as tetravalent cerium salts. Examples of reducing substances include reducing metal salts (including divalent iron salts, monovalent copper salts and trivalent chromium salts), ammonia, lower amines (including amines having about 1 to 6 carbon atoms in the manner of methylamine and ethylamine), amino compounds in the manner of hydroxylamine, and reducing sulfur compounds such as sodium thiosulfate, sodium hydrosulfite, sodium hydrogen sulfite, sodium sulfite and sodium formaldehyde sulfoxylate, lower alcohols (having 1 to 6 carbon atoms), ascorbic acid and salts thereof, and lower aldehydes (having 1 to 6 carbon atoms).

The polymerization initiator is selected with reference to the 10 hour half-life temperature, and is used either alone or as a mixture. Although varying according to the target degree of polymerization, the amount of the above-mentioned polymerization initiator added is typically 0.5 parts by mass to 20.0 parts by mass based on 100.0 parts by mass of the polymerizable monomer.

In addition, a known chain transfer agent for controlling degree of polymerization, or a polymerization inhibitor, can be further added.

Various types of crosslinking agents can be used in the case of polymerizing a polymerizable monomer. Examples of crosslinking agents include polyfunctional compounds in the manner of divinylbenzene, 4,4'-divinylbiphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate and trimethylolpropane trimethacrylate.

As a dispersion stabilizer, a known inorganic compound dispersion stabilizer or organic compound dispersion stabilizer can be used when preparing the aqueous medium. Examples of inorganic compound dispersion stabilizers include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. On the other hand, examples of organic compound dispersion stabilizers include polyvinyl alcohol, gelatin, methyl cellulose, methyl hydroxypropyl cellulose, ethyl cellulose, sodium salts of carboxymethyl cellulose, polyacrylic acid and salts thereof and starch. The amount of these dispersion stabilizers used is preferably 0.2 parts by mass to 20.0 parts by mass based on 100.0 parts by mass of the polymerizable monomer.

Among these dispersion stabilizers, although a commercially available product may be used as is in the case of using an inorganic compound dispersion stabilizer, the inorganic compound may be formed in an aqueous medium in order to obtain a dispersion stabilizer having a finer particle diameter. For example, in the case of tricalcium phosphate, the tricalcium phosphate is obtained by mixing an aqueous sodium phosphate solution and an aqueous calcium chloride solution while stirring rapidly.

External additives may be added externally to the toner particles in order to impart various types of characteristics to the toner. Examples of external additives for improving toner flowability include inorganic fine particles such as silica fine particles, titanium oxide fine particles and compound oxide fine particles thereof. Among these inorganic fine particles, silica fine particles and titanium oxide fine particles are preferable. For example, the toner of the present invention can be obtained by externally mixing inorganic fine particles and adhering to the surface of toner particles. A known method may be used for external addition of inorganic fine particles. For example, the inorganic fine particles may be mixed using a Henschel mixer (Mitsui Miike Machinery Co., Ltd.).

Examples of silica fine particles include dry silica or fumed silica formed by vapor phase oxidation of a silicon halide and wet silica produced from water glass. Dry silica having few silanol groups on the surface or inside the silica fine particles and having low contents of $Na_2O$ and $SO_3^{2-}$ are preferable for the inorganic fine particles. In addition, the dry silica may also be in the form of compound fine particles of silica and other metal oxides by using a metal halide compound in the manner of aluminum chloride or titanium chloride and the like with a silicon halide compound in the production process.

Since adjustment of triboelectric charge quantity of the toner, improvement of environmental stability and improvement of flowability at high temperatures and high humidity can be achieved by subjecting the surface of inorganic fine particles to hydrophobic treatment with a treatment agent, hydrophobically treated inorganic fine particles are used preferably. The absorption of moisture by inorganic fine particles externally added to the toner causes increased susceptibility to decreases in triboelectric charge quantity and flowability of the toner as well as decreases in developability and transferability.

Examples of treatment agents used in hydrophobic treatment of inorganic fine particles include unmodified silicone varnish, various types of modified silicone varnish, unmodified silicone oil, various types of modified silicon oil, silane compounds, silane coupling agents, other organic silicon compounds and organic titanium compounds. Among these, silicone oil is preferable. These treatment agents may be used alone or in combination.

The total amount of inorganic fine particles added is preferably 1.0 part by mass to 5.0 parts by mass and more preferably 1.0 part by mass to 2.5 parts by mass based on 100.0 parts by mass of the toner particles. External additives preferably have a particle diameter equal to or less than 1/10 the average particle diameter of the toner particles from the viewpoint of durability when added to the toner.

The following provides an explanation of methods used to measure various physical properties according to the present invention.

<Calculation of SP Value>

SP values in the present invention were determined using the formula (3) of Fedors. Refer to "Evaporation Energies and Molar Volumes (25° C.) of Atoms and Atomic Groups according to Tables 3 to 9 of Basic Coating Science", pp. 54-57, 1986 (Maki Shoten K.K.) for information on the values for Δei and Δvi in the following equation.

$$\delta i=[Ev/V]^{(1/2)}=[\Delta ei/\Delta vi]^{(1/2)} \quad \text{Equation(3)}$$

Ev: Evaporation energy

V: Molar volume

Δei: Evaporation energy of atom or atomic group of component i

Δvi: Molar volume of atom or atomic group of component i

For example, the calculated SP value of hexanediol is determined according to the following equation since it is composed of atomic groups represented by (—OH)×2+(—$CH_2$)×6:

$$\delta i=[\Delta ei/\Delta vi^{(1/2)}=[\{(5220)\times 2+(1180)\times 6\}/\{(13)\times 2+(16.1)\times 6\}]^{(1/2)}, \text{ and}$$

the SP value becomes 11.95.

<Measurement of Molecular Weight>

Weight-average molecular weight (Mw) and number average molecular weight (Mn) of the block polymer are measured in the manner described below by gel permeation chromatography (GPC).

First, the block polymer is dissolved in tetrahydrofuran (THF) at room temperature. The resulting solution is then filtered with a solvent-resistant membrane filter (Maishori Disk, TOSOH CORPORATION) having a pore diameter of 0.2 μm to obtain a sample solution. Furthermore, the concentration of components soluble in THF in the sample solution is adjusted to 0.8% by mass. Molecular weight is measured under the following conditions using this sample solution.

Apparatus: High-performance GPC apparatus (HLC-8220GPC, TOSOH CORPORATION)

Column: Dual LF-604 columns

Eluent: THF

Flow rate: 0.6 ml/min

Oven temperature: 40° C.

Sample injection volume: 0.020 ml

When calculating the molecular weight of the sample, a molecular weight calibration curve is used that was prepared using standard polystyrene resins (such as TSK Standard Polystyrenes (trade name) F-850, F-450, F-288, F-128, F-80, F-40, F-20, F-10, F-4, F-2, F-1, A-5000, A-2500, A-1000 and A-500, TOSOH CORPORATION).

Furthermore, the molecular weight of the vinyl polymer segment of the block polymer is measured by hydrolyzing the polyester segment of the block polymer.

More specifically, 5 ml of dioxane and 1 ml of 10% by weight aqueous potassium hydroxide solution are added to 30 mg of the block polymer followed by shaking for 6 hours at 70° C. to hydrolyze the polyester segment. Subsequently, the solution is dried to produce a sample for measuring the molecular weight of the vinyl polymer segment. The remainder of the procedure is the same as that for the block polymer.

<Measurement of Ratio of Polyester Segment to Vinyl Polymer Segment of Block Polymer>

The ratio of the polyester segment to the vinyl polymer segment of the block polymer is measured using nuclear magnetic resonance spectral analysis ($^1$H-NMR, 400 MHz, $CDCl_3$, room temperature (25° C.)).

Measuring instrument: JNM-EX400 FT-NMR apparatus (JEOL Ltd.)

Measuring frequency: 400 MHz

Pulse conditions: 5.0 μs

Frequency range: 10500 Hz

Number of scans: 64

The mass ratio (C/A ratio) of the polyester segment to the vinyl polymer segment was calculated from the integration values of the resulting spectrum.

<Measurement of Melting Point>

The melting point (Tm) of the block polymer is measured in compliance with ASTM D3418-82 using the Q1000 Differential Scanning calorimeter (TA Instruments Inc.).

The melting points of indium and zinc are used to calibrate the temperature of the apparatus detection unit, and the heat of fusion of indium is used to calibrate calorific value.

More specifically, 5 mg of block polymer are accurately weighed followed by placing in an aluminum pan, an empty aluminum pan is used as a reference, and measurement is carried out over a measuring temperature range of 30° C. to 200° C. at a ramp rate of 10° C./min. Furthermore, the temperature is first raised to 200° C. followed by lowering to 30° C. and subsequently raised again when carrying out measurement. The maximum endothermic peak on the DSC curve over the temperature range of 30° C. to 200° C. during the second time the temperature is raised is taken to be the melting point of the block polymer of the present invention (Tm) as determined by DSC measurement.

<Separation of Styrene Acrylic Resin and Block Polymer from Toner>

The following method, for example, is used to separate the styrene acrylic resin and block polymer from the toner. Various physical properties can be identified by carrying out separation according to the following method and further identifying structure or calculating SP values and the like.

(Separation of Wax from Toner by Fractionation Gel Permeation Chromatography (GPC))

Tetrahydrofuran (THF)-soluble components of the toner can be obtained by dissolving the toner in tetrahydrofuran (THF) and distilling off the solvent from the resulting soluble matter.

The resulting toner tetrahydrofuran (THF)-soluble components are dissolved in chloroform to prepare a sample solution having a concentration of 25 mg/ml.

3.5 ml of the resulting sample solution are injected into the following apparatus followed by fractionating a resin component in the form of fractions having a number average molecular weight (Mn) of 2,000 or more under the conditions indicated below.

Fractionation GPC apparatus: Model LC-980 Fractionation HPLC (Japan Analytical Industry Co., Ltd.)

Fractionation column: JAIGEL 3H, JAIGEL 5H (Japan Analytical Industry Co., Ltd.)

Eluent: Chloroform

Flow rate: 3.5 ml/min

When calculating the molecular weight of the sample, a molecular weight calibration curve is used that was prepared using standard polystyrene resins (such as TSK Standard Polystyrenes (trade name) F-850, F-450, F-288, F-128, F-80, F-40, F-20, F-10, F-4, F-2, F-1, A-5000, A-2500, A-1000 and A-500, TOSOH CORPORATION).

After fractioning high molecular weight components derived from the resin, the solvent is distilled off followed by drying for 24 hours under reduced pressure in an atmosphere at 90° C. The above-mentioned procedure is repeated until about 100 mg of the resin component is obtained.

(Separation of Styrene Acrylic Resin and Block Polymer)

After adding 500 ml of acetone to 100 mg of resin obtained according to the above-mentioned procedure and completely dissolving by heating to 70° C., the solution is gradually cooled to 25° C. to recrystallize the block polymer. The mixture is then separated into crystalline block polymer and filtrate by suction filtration. The separated filtrate is gradually added to 500 ml of methanol to re-precipitate the styrene acrylic resin. The styrene acrylic resin was removed with a suction filter. The resulting styrene acrylic resin and block polymer were vacuum-dried for 24 hours at 40° C.

<Identification of Structures of Styrene Acrylic Resin and Block Polymer>

The structures of the styrene acrylic resin and block polymer were identified using nuclear magnetic resonance spectral analysis ($^1$H-NMR, 400 MHz, $CDCl_3$, room temperature (25° C.)).

Measuring instrument: JNM-EX400 FT-NMR apparatus (JEOL Ltd.)

Measuring frequency: 400 MHz

Pulse conditions: 5.0 μs

Frequency range: 10500 Hz

Number of scans: 64

<Measurement of Block Polymer Content in Binder Resin from Toner>

The content of the block polymer was calculated from the integration values of the nuclear magnetic resonance spectral analysis ($^1$H-NMR) spectrum of the toner based on the respectively nuclear magnetic resonance spectral ($^1$H-NMR) spectrum of the styrene acrylic resin and block polymer.

Measuring instrument: JNM-EX400 FT-NMR apparatus (JEOL Ltd.)

Measuring frequency: 400 MHz

Pulse conditions: 5.0 μs

Frequency range: 10500 Hz

Number of scans: 64

The following provides a more detailed explanation of the present invention through examples thereof. The present invention is not limited by the following examples. Furthermore, numbers of parts and percentages (%) in the examples and comparative examples are all based on mass unless specifically indicated otherwise.

First, a description is provided of block polymers used in the examples.

<Production of Block Polymer 1>

100.0 parts by mass of sebacic acid and 93.5 parts by mass of 1,10-decanediol were added to a reaction vessel equipped with a stirrer, thermometer, nitrogen inlet tube, evaporation tube and pressure reducing device followed by heating to a temperature of 130° C. while stirring. After adding 0.7 parts by mass of titanium (IV) isopropoxide as esterification catalyst, the mixture was heated to a temperature of 160° C. followed by carrying out condensation polymerization over the course of 5 hours. Subsequently, the temperature was raised to 180° C. and the mixture was allowed to react under reduced pressure until the desired molecular weight was achieved to obtain polyester (1). The weight-average molecular weight (Mw) of polyester (1) was 19,000 and the melting point (Tm) was 83° C.

Next, 100.0 parts by mass of polyester (1) and 440.0 parts by mass of dehydrated chloroform were added to a reaction vessel equipped with a stirrer, thermometer and nitrogen inlet tube and completely dissolved followed by adding 5.0 parts by mass of triethylamine and gradually adding 15.0 parts by mass of 2-bromoisobutyrylbromide while cooling with ice. Subsequently, the solution was stirred for one day at room temperature (25° C.)

The above-mentioned resin solution was gradually dropped into a vessel containing 550.0 parts by mass of methanol to re-precipitate the resin fraction followed by filtering, purifying and drying to obtain polyester (2).

Next, 100.0 parts by mass of polyester (2) obtained above, 300.0 parts by mass of styrene, 3.5 parts by mass of copper (I) bromide and 8.5 parts by mass of pentamethyldiethylenetriamine were added to a reaction vessel equipped with a stirrer, thermometer and nitrogen inlet tube followed by carrying out a polymerization reaction at a temperature of 110° C. while stirring. The reaction was stopped when the desired molecular weight was reached followed by re-precipitating with 250.0 parts by mass of methanol, filtering and purifying to remove unreacted styrene and catalyst. Subsequently, the mixture was dried with a vacuum dryer set to 50° C. to obtain block polymer 1 having a polyester segment and a vinyl polymer segment. The physical properties of the resulting block polymer 1 are shown in Table 3.

<Production of Block Polymers 2-8, 10, 12, 14, 16, 18-24 and 26>

Block polymers 2 to 8, 10, 12, 14, 16, 18 to 24 and 26 were obtained using the same method as that used to produce block polymer 1 with the exception of changing to the raw materials and production conditions shown in Table 1. The physical properties of the resulting block polymers 2 to 8, 10, 12, 14, 16, 18 to 24 and 26 are shown in Table 3.

<Production of Block Polymer 9>

100.0 parts by mass of xylene were heated in a reaction vessel equipped with a stirrer, thermometer, nitrogen inlet tube and pressure reducing device while replacing the atmosphere inside the vessel with nitrogen followed by refluxing at a liquid temperature of 140° C. A mixture of 100.0 parts by mass of styrene and 6.0 parts by mass of dimethyl 2,2'-azobis(2-methylpropionate) was dropped into the solution over the course of 3 hours, and following completion of dropping, the solution was stirred for 3 hours. Subsequently, xylene and residual styrene were distilled off at 160° C. and 1 hPa to obtain vinyl polymer (1).

Next, 0.43 parts of titanium (IV) isopropoxide as esterification catalyst were added to 100.0 parts by mass of the vinyl polymer (1) obtained above, 80.0 parts of xylene as organic solvent and 27.1 parts by mass of 1,6-hexanediol in a reaction vessel equipped with a stirrer, thermometer, nitrogen inlet tube, evaporation tube and pressure reducing device and allowed to react for 4 hours at 150° C. in a nitrogen atmosphere. Subsequently, 40.7 parts by mass of 1,12-dodecanedioic acid were added and allowed to react for 3 hours at 150° C. and then for 4 hours at 180° C. Subsequently, the reaction was allowed to proceed at 180° C. and 1 hPa until the desired Mw was reached to obtain block polymer 9.

<Production of Block Polymers 11, 13, 15, 17, 25 and 27-30>

Block polymers 11, 13, 15, 17, 25 and 27 to 30 were obtained using the same method as the method used to produce block polymer 9 with the exception of changing the production conditions of block polymer 9 to those shown in Table 2. The physical properties of the resulting block polymers 11, 13, 15, 17, 25 and 27 to 30 are shown in Table 3.

<Production of Graft Polymer>

100.0 parts by mass of sebacic acid and 93.5 parts by mass of 1,10-decanediol were added to a reaction vessel equipped with a stirrer, thermometer, nitrogen inlet tube, dehydration tube and pressure reducing device followed by heating to 130° C. while stirring. After adding 0.7 parts by mass of titanium (IV) isopropoxide, the temperature was raised to 160° C. followed by carrying out condensation polymerization over the course of 5 hours. 15.0 parts by mass of acrylic acid and 140.0 parts by mass of styrene were dropped in over the course of 1 hour. After continuing to stir for 1 hour while holding at 160° C., the monomer of the styrene resin component was removed for 1 hour at 8.3 kPa. Subsequently, the temperature was raised to 210° C. and the reaction was allowed to proceed until the desired molecular weight was reached to obtain a graft polymer. The physical properties of the graft polymer are shown in Table 3.

TABLE 1

| | Polyester segment | | | | | Vinyl polymer segment | | |
|---|---|---|---|---|---|---|---|---|
| Block polymer No. | Acid monomer | Parts by mass | Alcohol monomer | Parts by mass | Reaction conditions | Vinyl monomer | Parts by mass | Reaction temperature |
| 1 | Sebacic acid | 100.0 | 1,10-decanediol | 93.5 | 160° C./5 H | Styrene = 100 | 300.0 | 110° C. |
| 2 | Sebacic acid | 100.0 | 1,9-nonanediol | 83.0 | 160° C./5 H | Styrene:MMA = 92:8 | 300.0 | 110° C. |
| 3 | Dodecanedioic acid | 100.0 | 1,6-hexanediol | 54.5 | 160° C./5 H | Styrene:n-BA = 95:5 | 300.0 | 110° C. |
| 4 | Sebacic acid | 100.0 | 1,9-nonanediol | 83.0 | 160° C./5 H | Styrene = 100 | 400.0 | 110° C. |
| 5 | Sebacic acid | 100.0 | 1,9-nonanediol | 83.0 | 160° C./5 H | Styrene = 100 | 250.0 | 110° C. |
| 6 | Sebacic acid | 100.0 | 1,9-nonanediol | 83.0 | 160° C./5 H | Styrene = 100 | 450.0 | 110° C. |
| 7 | Sebacic acid | 100.0 | 1,9-nonanediol | 83.0 | 160° C./5 H | Styrene = 100 | 200.0 | 110° C. |
| 8 | Dodecanedioic acid | 100.0 | 1,6-hexanediol | 54.5 | 140° C./7 H | Styrene = 100 | 200.0 | 110° C. |
| 10 | Dodecanedioic acid | 100.0 | 1,6-hexanediol | 54.5 | 160° C./5 H | Styrene = 100 | 200.0 | 110° C. |
| 12 | Dodecanedioic acid | 100.0 | 1,6-hexanediol | 54.5 | 130° C./7 H | Styrene = 100 | 200.0 | 110° C. |
| 14 | Dodecanedioic acid | 100.0 | 1,6-hexanediol | 54.5 | 130° C./7 H | Styrene = 100 | 300.0 | 100° C. |
| 16 | Dodecanedioic acid | 100.0 | 1,6-hexanediol | 54.5 | 130° C./7 H | Styrene = 100 | 300.0 | 90° C. |
| 18 | Sebacic acid | 100.0 | 1,7-heptanediol | 68.5 | 160° C./5 H | Styrene = 100 | 300.0 | 110° C. |
| 19 | Sebacic acid | 100.0 | 1,12-dodecanediol | 106.5 | 160° C./5 H | Styrene = 100 | 300.0 | 110° C. |
| 20 | Sebacic acid | 100.0 | 1,6-hexanediol | 54.5 | 160° C./5 H | Styrene = 100 | 300.0 | 110° C. |
| 21 | Dodecanedioic acid | 100.0 | 1,12-dodecanediol | 94.0 | 160° C./5 H | Styrene = 100 | 300.0 | 110° C. |
| 22 | Suberic acid | 100.0 | 1,7-heptanediol | 80.0 | 160° C./5 H | Styrene = 100 | 300.0 | 110° C. |
| 23 | Tetradecanedioic acid | 100.0 | 1,12-dodecanediol | 84.0 | 160° C./5 H | Styrene = 100 | 300.0 | 110° C. |
| 24 | Dodecanedioic acid | 100.0 | 1,6-hexanediol | 54.4 | 160° C./5 H | Styrene = 100 | 200.0 | 110° C. |
| 26 | Pimelic acid | 100.0 | 1,5-pentandiol | 68.0 | 160° C./5 H | Styrene = 100 | 300.0 | 110° C. |

TABLE 2

| | Polyester segment | | | | | Vinyl polymer segment | | |
|---|---|---|---|---|---|---|---|---|
| Block polymer No. | Acid monomer | Parts by mass | Alcohol monomer | Parts by mass | Initial reaction temperature (° C.) | Vinyl monomer | Parts of initiator | Reaction temperature (° C.) |
| 9 | Dodecanedioic acid | 40.7 | 1,6-hexanediol | 27.1 | 150 | Styrene | 6.0 | 140 |
| 11 | Dodecanedioic acid | 74.0 | 1,6-hexanediol | 49.2 | 150 | Styrene | 6.0 | 140 |
| 13 | Dodecanedioic acid | 74.0 | 1,6-hexanediol | 49.2 | 180 | Styrene | 5.5 | 150 |
| 15 | Dodecanedioic acid | 74.0 | 1,6-hexanediol | 49.2 | 150 | Styrene | 10.0 | 130 |
| 17 | Dodecanedioic acid | 74.0 | 1,6-hexanediol | 49.2 | 150 | Styrene | 10.0 | 140 |
| 25 | Dodecanedioic acid | 74.0 | 1,6-hexanediol | 49.2 | 150 | Styrene | 5.0 | 140 |
| 27 | Sebacic acid | 190.0 | 1,9-nonanediol | 208.2 | 150 | Styrene | 11.0 | 145 |
| 28 | Sebacic acid | 264.5 | 1,9-nonanediol | 288.3 | 150 | Styrene | 11.0 | 145 |
| 29 | Dodecanedioic acid | 74.0 | 1,6-hexanediol | 49.2 | 150 | Styrene | 12.5 | 145 |
| 30 | Dodecanedioic acid | 74.0 | 1,6-hexanediol | 49.2 | 160 | Styrene | 12.5 | 145 |

TABLE 3

| | Polyester segment | | | Vinyl polymer segment | | Entire block polymer | | | | |
|---|---|---|---|---|---|---|---|---|---|---|
| | Mw | Tm (° C.) | SP value | Mw | Mw/Mn | Mw | Mw/Mn | C/A ratio | Tm (° C.) | SP value |
| Block polymer 1 | 19000 | 83 | 9.57 | 7500 | 1.8 | 33000 | 1.7 | 55/45 | 76 | 9.68 |
| Block polymer 2 | 20000 | 73 | 9.62 | 7700 | 1.8 | 34000 | 1.7 | 55/45 | 64 | 9.71 |
| Block polymer 3 | 18500 | 80 | 9.67 | 7500 | 1.8 | 32500 | 1.7 | 55/45 | 71 | 9.74 |
| Block polymer 4 | 13000 | 72 | 9.62 | 9500 | 1.8 | 32000 | 1.7 | 40/60 | 63 | 9.74 |
| Block polymer 5 | 23800 | 73 | 9.62 | 6200 | 1.8 | 35000 | 1.7 | 65/35 | 66 | 9.69 |
| Block polymer 6 | 6000 | 70 | 9.62 | 10200 | 1.8 | 31500 | 1.7 | 35/65 | 62 | 9.75 |
| Block polymer 7 | 26000 | 74 | 9.62 | 5400 | 1.8 | 36000 | 1.7 | 70/30 | 69 | 9.68 |
| Block polymer 8 | 12600 | 79 | 9.67 | 4000 | 1.8 | 21000 | 1.5 | 60/40 | 70 | 9.73 |
| Block polymer 9 | — | — | 9.67 | 13500 | 2.8 | 44000 | 3.3 | 40/60 | 69 | 9.76 |
| Block polymer 10 | 11000 | 79 | 9.67 | 4000 | 1.8 | 19000 | 1.8 | 55/45 | 68 | 9.74 |
| Block polymer 11 | — | — | 9.67 | 13500 | 2.8 | 46000 | 3.4 | 55/45 | 68 | 9.74 |
| Block polymer 12 | 10500 | 79 | 9.67 | 4100 | 1.8 | 19000 | 1.3 | 55/45 | 70 | 9.74 |
| Block polymer 13 | — | — | 9.67 | 13500 | 2.8 | 46000 | 3.8 | 55/45 | 68 | 9.74 |
| Block polymer 14 | 20500 | 79 | 9.67 | 7500 | 1.4 | 34500 | 1.6 | 55/45 | 71 | 9.74 |
| Block polymer 15 | — | — | 9.67 | 6800 | 3.4 | 36000 | 3.3 | 55/45 | 70 | 9.74 |
| Block polymer 16 | 22000 | 79 | 9.67 | 7500 | 1.2 | 37000 | 1.5 | 55/45 | 71 | 9.74 |
| Block polymer 17 | — | — | 9.67 | 6300 | 3.8 | 38000 | 3.3 | 55/45 | 69 | 9.74 |
| Block polymer 18 | 18500 | 69 | 9.74 | 7500 | 1.8 | 32500 | 1.7 | 55/45 | 62 | 9.77 |
| Block polymer 19 | 19000 | 88 | 9.48 | 7500 | 1.8 | 33000 | 1.7 | 55/45 | 78 | 9.64 |
| Block polymer 20 | 19500 | 72 | 9.80 | 7500 | 1.8 | 33000 | 1.7 | 55/45 | 65 | 9.81 |
| Block polymer 21 | 18500 | 89 | 9.45 | 7500 | 1.8 | 33500 | 1.7 | 55/45 | 83 | 9.59 |
| Block polymer 22 | 18500 | 68 | 9.88 | 7500 | 1.8 | 34000 | 1.7 | 55/45 | 62 | 9.85 |
| Block polymer 23 | 19500 | 95 | 9.35 | 7500 | 1.8 | 34500 | 1.7 | 55/45 | 91 | 9.56 |
| Block polymer 24 | 7400 | 70 | 9.67 | 3500 | 1.8 | 16800 | 1.7 | 55/45 | 69 | 9.74 |
| Block polymer 25 | — | — | 9.67 | 15800 | 2.8 | 35000 | 2.8 | 55/45 | 70 | 9.74 |
| Block polymer 26 | 19000 | 53 | 10.18 | 7500 | 1.8 | 34000 | 1.7 | 55/45 | 49 | 10.01 |
| Graft polymer | — | — | 9.67 | — | — | 78500 | 4.2 | 60/40 | 70 | 9.68 |
| Block polymer 27 | — | — | 9.62 | 5400 | 2.8 | 27000 | 1.7 | 80/20 | 70 | 9.66 |
| Block polymer 28 | — | — | 9.62 | 5400 | 2.8 | 35000 | 1.7 | 85/15 | 72 | 9.65 |
| Block polymer 29 | — | — | 9.67 | 4000 | 2.8 | 15000 | 3.3 | 55/45 | 68 | 9.74 |
| Block polymer 30 | — | — | 9.67 | 4000 | 2.8 | 14000 | 3.3 | 55/45 | 68 | 9.74 |

<Production of Negative Chargeability Control Resin 1>

255.0 parts by mass of methanol, 145.0 parts by mass of 2-butanone and 100.0 parts by mass of 2-propanol as solvent were added to a reaction vessel equipped with a reflux condenser, stirrer, thermometer, nitrogen inlet tube, dropping device and pressure reducing device followed by the addition of 88.0 parts by mass of styrene, 6.0 parts by mass of 2-ethylhexyl acrylate and 5.0 parts by mass of 2-acrylamido-2-methylpropanesulfonate as polymerizable monomers and heating to the reflux temperature while stirring. A solution obtained by diluting 1.0 part by mass of a polymerization initiator in the form of 2,2'-azobisisobutyronitrile with 20 parts by mass of 2-butanone was dropped in over the course of 30 minutes followed by continuing to stir for 5 hours. Moreover, a solution obtained by diluting 1.2 parts by mass of 2,2'-azobisisobutyronitrile with 20 parts by mass of 2-butanone was dropped in over the course of 30 minutes followed by stirring for 5 hours to complete polymerization and obtain a condensate.

Next, after distilling off the polymerization solvents under reduced pressure, the resulting condensate was coarsely pulverized to 100 μm or smaller with a cutter mill equipped with a 150 mesh screen (pore size: 104 μm) and then finely pulverized with a jet mill. The fine powder was then classified with a 250 mesh sieve (pore size: 61 μm) to separate and obtain particles of 60 μm or less. Next, the particles were dissolved by addition of methyl ethyl ketone (MEK) to a concentration of 10%, and the resulting solution was re-precipitated by gradually adding to methanol at 20 times the amount of MEK. The resulting precipitate was washed with one-half the amount of methanol used for re-precipitation, and the filtered particles were vacuum-dried at 35° C. for 48 hours.

Moreover, the above-mentioned vacuum-dried particles were re-dissolved by addition of MEK to a concentration of 10%, and the resulting solution was re-precipitated by gradually adding to n-hexane at 20 times the amount of MEK. The resulting precipitate was washed with one-half the amount of n-hexane used for re-precipitation, and the filtered particles were vacuum-dried for 48 hours at 35° C. to obtain a polar polymer. The polar polymer obtained in this manner had a glass transition temperature Tg of about 83° C., main peak distribution (Mp) of 21,500, number average molecular weight (Mn) of 11,000, weight-average molecular weight (Mw) of 33,000 and acid value of 14.5 mgKOH/g. In addition, the composition as measured by $^{1}$H-NMR (EX-400, JEOL Ltd., 400 MHz) comprised styrene, 2-ethylhexyl acrylate and 2-acrylamide-2-methylpropanesulfonate at a mass ratio of 88.0:6.0:5.0. The resulting polar polymer was designated as negative chargeability control resin 1.

<Production of Toner 1>

9.0 parts by mass of tricalcium phosphate were added to 1300.0 parts by mass of ion exchange water warmed to a temperature of 60° C. followed by stirring at a stirring speed of 15,000 rpm using a TK Homo Mixer (Tokushu Kika Kogyo Co., Ltd.) to prepare an aqueous medium.

In addition, the following binder resin materials were mixed while stirring at a stirring speed of 100 rpm with a propeller-type stirrer to prepare a mixed liquid.

| | |
|---|---|
| Styrene | 50.0 parts by mass |
| n-butyl acrylate | 15.0 parts by mass |
| Block polymer 1 | 35.0 parts by mass |
| Next, the following: | |
| cyan colorant (C.I. Pigment Blue 15:3) | 6.5 parts by mass |
| negative charge control agent (Bontron E-88, Orient Chemical Industries, Ltd.) | 0.5 parts by mass |
| hydrocarbon wax (Tm = 78° C.) | 9.0 parts by mass |
| negative chargeability control resin 1 | 0.7 parts by mass |
| polar resin (styrene-2-hydroxyethylmethacrylate-methacrylic acid-methyl methacrylate polymer, acid value: 10 mg KOH/g, Tg = 80° C., Mw = 15,000) | 5.0 parts by mass |

were added to the above-mentioned solution followed by heating the mixed solution to a temperature of 65° C., stirring with a TK Homo Mixer (Tokushu Kika Kogyo Co., Ltd.) at a stirring speed of 10,000 rpm, dissolving and dispersing to prepare a polymerizable monomer composition.

Continuing, the above-mentioned polymerizable monomer composition was added to the above-mentioned aqueous medium followed by the addition of 6.0 parts by mass of polymerization initiator in the form of Perbutyl PV (10 hour half-life temperature: 54.6° C., NOF CORPORATION), stirring at 70° C. for 20 minutes at a stirring speed of 15,000 rpm using a TK Homo Mixer, and granulating.

Polymerizable monomers in the polymerizable monomer composition in the form of styrene and n-butyl acrylate were than reacted for 5 hours at 85° C. while stirring at a stirring speed of 200 rpm after transferring to a propeller-type stirrer to produce a slurry containing toner particles. The slurry was cooled following completion of the polymerization reaction. Hydrochloric acid was added to the cooled slurry to adjust the pH to 1.4 followed by stirring for 1 hour to dissolve the calcium phosphate salt. Subsequently, the slurry was washed with water at 10 times the volume of the slurry followed by filtering, drying and adjusting the particle diameter by classification to obtain toner particles. The toner particles contained 65.0 parts by mass of styrene acrylic resin, 35.0 parts by mass of block polymer, 6.5 parts by mass of cyan colorant, 9.0 parts by mass of wax, 0.5 parts by mass of negative charge control agent, 0.7 parts by mass of negative chargeability control resin 1 and 5.0 parts by mass of polar resin.

1.5 parts by mass of an external additive in the form of hydrophobic silica fine particles, obtained by treating silica fine particles with 20% by mass dimethyl silicone oil (primary particle diameter: 7 nm, BET specific surface area: 130 $m^2/g$), were mixed with 100.0 parts by mass of the above-mentioned toner particles for 15 minutes at a stirring speed of 3,000 rpm with a Henschel mixer (Mitsui Miike Machinery Co., Ltd.) to obtain toner 1. The physical properties of toner 1 are shown in Table 4.

<Production of Toners 2-30 and Toners 34-45>

Toners 2 to 30 and toners 34 to 45 were obtained using the same method as the method used to produce toner 1 with the exception of changing the raw materials and number of parts added as shown in Table 4.

<Production of Toner 31>

| | |
|---|---|
| Styrene acrylic resin (copolymer of styrene and n-butyl acrylate, mass ratio = 80:20) (Mw = 30,000, Tg = 55° C.) | 65.0 parts by mass |
| Block polymer 5 | 35.0 parts by mass |
| Methyl ethyl ketone | 100.0 parts by mass |
| Ethyl acetate | 100.0 parts by mass |
| Hydrocarbon wax (Tm = 78° C.) | 9.0 parts by mass |
| Cyan pigment (C.I. Pigment Blue 15:3) | 6.5 parts by mass |
| Negative chargeability control resin 1 | 1.0 part by mass |

The above-mentioned materials were dispersed for 3 hours using an attritor (Mitsui Mining & Smelting Co., Ltd.) to obtain a colorant-dispersed solution.

On the other hand, 27.0 parts by mass of calcium phosphate were added to 3,000.0 parts by mass of ion exchange water warmed to a temperature of 60° C. followed by stirring at a stirring speed of 10,000 rpm using a TK Homo Mixer (Tokushu Kika Kogyo Co., Ltd.) to prepare an aqueous medium. The above-mentioned colorant-dispersed solution was added to the above-mentioned aqueous medium followed by stirring for 15 minutes at a stirring speed of 12,000 rpm with a TK Homo Mixer in an $N_2$ atmosphere at a temperature of 65° C. and granulating the colorant particles. Subsequently, after switching from the TK Homo Mixer to an ordinary propeller-type stirrer, the internal temperature was raised to 95° C. while maintaining the stirring speed of the stirrer at 150 rpm followed by holding at that temperature for 3 hours to remove the solvent from the dispersion and prepare a dispersion of toner particles.

Hydrochloric acid was added to the resulting dispersion of toner particles to adjust the pH to 1.4 followed by stirring for 1 hour to dissolve the calcium phosphate salt. The above-mentioned dispersion was then filtered and washed with a pressure filter to obtain a toner condensate. Subsequently, the toner condensate was crushed and dried to obtain toner particles. The toner particles contained 65.0 parts by mass of styrene acrylic resin, 35.0 parts by mass of block polymer, 6.5 parts by mass of cyan colorant, 9.0 parts by mass of wax and 1.0 part by mass of negative chargeability control resin 1. 1.5 parts by mass of an external additive in the form of hydrophobic silica fine particles, obtained by treating silica fine particles with 20% by mass dimethyl silicone oil (primary particle diameter: 7 nm, BET specific surface area: 130 $m^2/g$), were mixed with 100.0 parts by mass of the above-mentioned toner particles for 15 minutes at a stirring speed of 3,000 rpm with a Henschel mixer (Mitsui Miike Machinery Co., Ltd.) to obtain toner 31. The physical properties of toner 31 are shown in Table 4.

<Production of Toner 32>

| (Preparation of Resin Particle Dispersion 1) | |
|---|---|
| Styrene | 75.0 parts by mass |
| n-butyl acrylate | 25.0 parts by mass |

The above-mentioned materials were mixed and dissolved followed by dispersing and emulsifying in a solution obtained by dissolving 1.5 parts by mass of a nonionic surfactant (Nonipol 400, Sanyo Chemical Industries, Ltd.) and 2.2 parts by mass of an anionic surfactant (Neogen SC, Daiichi Kogyo Seiyaku Co., Ltd.) in 120.0 parts by mass of ion exchange water, adding 10.0 parts by mass of ion exchange water containing 1.5 parts by mass of a polymerization initiator in the form of ammonium persulfate dissolved therein while mixing slowly for 10 minutes, replacing the atmosphere in the reaction vessel with nitrogen, heating the contents to a temperature of 70° C. while stirring and continuing emulsification polymerization for 4 hours at that temperature to prepare resin particle dispersion 1 having resin particles having an average particle diameter of 0.29 μm dispersed therein.

(Preparation of Resin Particle Dispersion 2)

* Block polymer 5 100.0 parts by mass was dissolved and then dispersed and emulsified in a solution obtained by dissolving 1.5 parts by mass of a nonionic surfactant (Nonipol 400, Sanyo Chemical Industries, Ltd.) and 2.2 parts by mass of an anionic surfactant (Neogen SC, Daiichi Kogyo Seiyaku Co., Ltd.) in 120.0 parts by mass of ion exchange water to prepare resin particle dispersion 2 having resin particles having an average particle diameter of 0.31 μm dispersed therein.

| (Preparation of Colorant Particle Dispersion) | |
|---|---|
| Cyan colorant (C.I. Pigment Blue 15:3) | 20.0 parts by mass |
| Anionic surfactant (Neogen SC, Daiichi Kogya Seiyaku Co., Ltd.) | 3.0 parts by mass |
| Ion exchange water | 78.0 parts by mass |

The above-mentioned materials were mixed and dispersed using a sand grinding mill. When the particle size distribution in this colorant particle dispersion was measured using a particle size distribution analyzer (LA-700, Horiba, Ltd.), the mean particle diameter of colorant particles contained therein was determined to be 0.2 μm while coarse particles having a mean particle diameter in excess of 1 μm were not observed.

| (Preparation of Wax Particle Dispersion) | |
|---|---|
| Hydrocarbon wax (Tm = 78° C.) | 50.0 parts by mass |
| Anionic surfactant (Neogen SC, Daiichi Kogya Seiyaku Co., Ltd.) | 7.0 parts by mass |
| Ion exchange water | 200 parts by mass |

The above-mentioned materials were heated to a temperature of 95° C. and dispersed using a homogenizer (Ultratalax T50, IKA WORKS, Inc.) followed by subjecting to dispersion treatment with a pressure-ejection homogenizer to prepare a wax particle dispersion having wax particles having a mean particle diameter of 0.5 μm dispersed therein.

| (Preparation of Charge Control Agent Particle Dispersion) | |
|---|---|
| Di-alkyl salicylic acid metal compound (Negative charge control agent, Bontron E-84, Orient Chemical Industries Co., Ltd.) | 5.0 parts by mass |
| Anionic surfactant (Neogen SC, Daiichi Seiyaku Kogyo Co., Ltd. ) | 3.0 parts by mass |
| Ion exchange water | 78.0 parts by mass |

The above-mentioned materials were mixed and dispersed using a sand grinding mill.

| (Preparation of Mixed Liquid) | |
|---|---|
| Resin particle dispersion 1 | 150.0 parts by mass |
| Resin particle dispersion 2 | 77.5 parts by mass |
| Colorant particle dispersion | 27.5 parts by mass |
| Wax particle dispersion | 45.0 parts by mass |

The above-mentioned materials were placed in a 1 liter separable flask equipped with a stirrer, reflux condenser and thermometer and stirred. The pH of this mixed liquid was adjusted to 5.2 using 1 mol/L potassium hydroxide. 120.0 parts by mass of a flocculant in the form of 8% aqueous sodium chloride solution were dropped into this mixed liquid followed by heating to a temperature of 55° C. while stirring. 10.0 parts by mass of charge control agent particle dispersion were added while at this temperature. After holding at a temperature of 55° C. for 2 hours, observation with a light microscope confirmed that aggregated particles having a mean particle diameter of 3.3 μm had been formed.

Subsequently, after adding 3.0 parts by mass of anionic surfactant (Neogen SC, Daiichi Kogyo Seiyaku Co., Ltd.) thereto, the mixture was heated to a temperature of 95° C. while continuing to stir followed by holding at that temperature for 4.5 hours. After cooling, the reaction product was filtered and adequately washed with ion exchange water followed by subjecting to fluidized bed drying at a temperature of 45° C. to obtain toner particles. The toner particles contained 65.0 parts by mass of styrene acrylic resin, 35.0 parts by mass of block polymer, 5.5 parts by mass of cyan colorant, 9.0 parts by mass of wax and 0.6 parts by mass of negative chargeability control resin.

1.5 parts by mass of an external additive in the form of hydrophobic silica fine particles, obtained by treating silica fine particles with 20% by mass dimethyl silicone oil (primary particle diameter: 7 nm, BET specific surface area: 130 $m^2/g$), were mixed with 100.0 parts by mass of the resulting toner particles for 15 minutes at a stirring speed of 3,000 rpm with a Henschel mixer (Mitsui Miike Machinery Co., Ltd.) to obtain toner 32. The physical properties of toner 32 are shown in Table 4.

<Production of Toner 33>

The following materials were preliminarily mixed followed by melting and kneading with a twin-screw extruder, coarsely pulverizing the cooled mixture with a hammer mill and classifying the resulting fine powder to obtain toner particles.

| | |
|---|---|
| Binder resin (styrene-n-butyl acrylate copolymer resin, Mw = 30,000, Tg = 50° C.) | 65.0 parts by mass |
| Block polymer 5 | 35.0 parts by mass |
| C.I. Pigment Blue 15:3 | 5.5 parts by mass |
| Di-alkyl salicylic acid metal compound (Bontron E-88, Orient Chemical Industries, Ltd.) | 3.0 parts by mass |
| Hydrocarbon wax (Tm = 78° C.) | 6.0 parts by mass |

1.5 parts by mass of an external additive in the form of hydrophobic silica fine particles, obtained by treating silica fine particles with 20.0% by mass dimethyl silicone oil (primary particle diameter: 7 nm, BET specific surface area: 130 $m^2/g$), were mixed with 100.0 parts by mass of the resulting toner particles for 15 minutes at a stirring speed of 3,000 rpm with a Henschel mixer (Mitsui Miike Machinery Co., Ltd.) to obtain toner 33. The physical properties of toner 33 are shown in Table 4.

TABLE 4

| | Binder resin | | | | | | Toner physical properties | | |
|---|---|---|---|---|---|---|---|---|---|
| | block polymer | Parts by mass | Styrene acrylic resin | SP value | Parts by mass | ΔSP value | D1 (μm) | D4 (μm) | Mw |
| Toner 1 | block polymer 1 | 35.0 | Styrene:n-butyl acrylate 78:22 | 9.80 | 65.0 | 0.12 | 4.9 | 5.5 | 32000 |
| Toner 2 | block polymer 2 | 35.0 | Styrene:n-butyl acrylate 78:22 | 9.80 | 65.0 | 0.09 | 4.8 | 5.6 | 31500 |
| Toner 3 | block polymer 3 | 35.0 | Styrene:n-butyl acrylate 78:22 | 9.80 | 65.0 | 0.06 | 4.8 | 5.3 | 33000 |
| Toner 4 | block polymer 1 | 10.0 | Styrene:n-butyl acrylate 78:22 | 9.80 | 90.0 | 0.12 | 5.2 | 5.8 | 30000 |
| Toner 5 | block polymer 1 | 6.0 | Styrene:n-butyl acrylate 78:22 | 9.80 | 94.0 | 0.12 | 5.3 | 5.8 | 32000 |
| Toner 6 | block polymer 1 | 50.0 | Styrene:n-butyl acrylate 78:22 | 9.80 | 50.0 | 0.12 | 5.0 | 5.6 | 38000 |
| Toner 7 | block polymer 1 | 5.0 | Styrene:n-butyl acrylate 78:22 | 9.80 | 95.0 | 0.12 | 5.1 | 5.5 | 34500 |
| Toner 8 | block polymer 1 | 55.0 | Styrene:n-butyl acrylate 78:22 | 9.80 | 45.0 | 0.12 | 5.2 | 5.9 | 34000 |
| Toner 9 | block polymer 4 | 35.0 | Styrene:n-butyl acrylate 78:22 | 9.80 | 65.0 | 0.06 | 4.8 | 5.5 | 34000 |
| Toner 10 | block polymer 5 | 35.0 | Styrene:n-butyl acrylate 78:22 | 9.80 | 65.0 | 0.11 | 4.9 | 5.5 | 35000 |
| Toner 11 | block polymer 6 | 35.0 | Styrene:n-butyl acrylate 78:22 | 9.80 | 65.0 | 0.05 | 4.8 | 5.6 | 32000 |
| Toner 12 | block polymer 7 | 35.0 | Styrene:n-butyl acrylate 78:22 | 9.80 | 65.0 | 0.12 | 4.7 | 5.7 | 34000 |
| Toner 13 | block polymer 8 | 35.0 | Styrene:n-butyl acrylate 78:22 | 9.80 | 65.0 | 0.07 | 4.8 | 5.8 | 29000 |
| Toner 14 | block polymer 9 | 35.0 | Styrene:n-butyl acrylate 78:22 | 9.80 | 65.0 | 0.04 | 4.9 | 6.1 | 39000 |
| Toner 15 | block polymer 10 | 35.0 | Styrene:n-butyl acrylate 78:22 | 9.80 | 65.0 | 0.06 | 5.0 | 5.9 | 28000 |
| Toner 16 | block polymer 11 | 35.0 | Styrene:n-butyl acrylate 78:22 | 9.80 | 65.0 | 0.06 | 4.7 | 6.0 | 39500 |
| Toner 17 | block polymer 12 | 35.0 | Styrene:n-butyl acrylate 78:22 | 9.80 | 65.0 | 0.06 | 4.6 | 5.6 | 29500 |
| Toner 18 | block polymer 13 | 35.0 | Styrene:n-butyl acrylate 78:22 | 9.80 | 65.0 | 0.06 | 4.7 | 5.8 | 38500 |
| Toner 19 | block polymer 14 | 35.0 | Styrene:n-butyl acrylate 78:22 | 9.80 | 65.0 | 0.06 | 4.9 | 5.4 | 33000 |
| Toner 20 | block polymer 15 | 35.0 | Styrene:n-butyl acrylate 78:22 | 9.80 | 65.0 | 0.06 | 5.0 | 6.1 | 35000 |
| Toner 21 | block polymer 16 | 35.0 | Styrene:n-butyl acrylate 78:22 | 9.80 | 65.0 | 0.06 | 5.1 | 5.8 | 34000 |
| Toner 22 | block polymer 17 | 35.0 | Styrene:n-butyl acrylate 78:22 | 9.80 | 65.0 | 0.06 | 4.5 | 5.9 | 33000 |
| Toner 23 | block polymer 18 | 35.0 | Styrene:n-butyl acrylate 78:22 | 9.80 | 65.0 | 0.03 | 4.9 | 5.6 | 35000 |
| Toner 24 | block polymer 19 | 35.0 | Styrene:n-butyl acrylate 78:22 | 9.80 | 65.0 | 0.16 | 4.8 | 5.7 | 33000 |
| Toner 25 | block polymer 20 | 35.0 | Styrene:n-butyl acrylate 78:22 | 9.80 | 65.0 | 0.01 | 4.9 | 5.9 | 35000 |
| Toner 26 | block polymer 21 | 35.0 | Styrene:n-butyl acrylate 78:22 | 9.80 | 65.0 | 0.21 | 4.7 | 5.7 | 34000 |
| Toner 27 | block polymer 5 | 35.0 | Styrene:iso-butyl acrylate 69:31 | 9.73 | 65.0 | 0.04 | 5.0 | 5.8 | 36000 |
| Toner 28 | block polymer 5 | 35.0 | Styrene:propyl acrylate 74:26 | 9.85 | 65.0 | 0.16 | 4.7 | 5.6 | 32000 |
| Toner 29 | block polymer 5 | 35.0 | Styrene:2-ethylhexyl acrylate 85:15 | 9.68 | 65.0 | 0.01 | 4.8 | 5.4 | 33000 |
| Toner 30 | block polymer 5 | 35.0 | Styrene:tert-butyl acrylate 28:72 | 9.48 | 65.0 | 0.21 | 4.9 | 5.5 | 36000 |
| Toner 31 | block polymer 5 | 35.0 | Styrene:n-butyl acrylate 80:20 | 9.80 | 65.0 | 0.11 | 4.7 | 5.5 | 38000 |
| Toner 32 | block polymer 5 | 35.0 | Styrene:n-butyl acrylate 75:25 | 9.80 | 65.0 | 0.11 | 4.8 | 5.8 | 32000 |
| Toner 33 | block polymer 5 | 35.0 | Styrene:n-butyl acrylate 78:22 | 9.80 | 65.0 | 0.11 | 4.3 | 6.1 | 30000 |
| Toner 34 | block polymer 22 | 35.0 | Styrene:n-butyl acrylate 78:22 | 9.80 | 65.0 | 0.05 | 4.9 | 5.8 | 32000 |
| Toner 35 | block polymer 23 | 35.0 | Styrene:n-butyl acrylate 78:22 | 9.80 | 65.0 | 0.24 | 4.9 | 6.0 | 34000 |
| Toner 36 | block polymer 24 | 35.0 | Styrene:n-butyl acrylate 78:22 | 9.80 | 65.0 | 0.06 | 4.8 | 5.5 | 35000 |
| Toner 37 | block polymer 25 | 35.0 | Styrene:n-butyl acrylate 78:22 | 9.80 | 65.0 | 0.06 | 4.3 | 5.9 | 32000 |
| Toner 38 | block polymer 26 | 35.0 | Styrene:n-butyl acrylate 78:22 | 9.80 | 65.0 | 0.21 | 4.8 | 5.5 | 33000 |
| Toner 39 | Graft polymer | 35.0 | Styrene:n-butyl acrylate 78:22 | 9.80 | 65.0 | 0.06 | 4.8 | 6.1 | 55000 |
| Toner 40 | block polymer 1 | 2.0 | Styrene:n-butyl acrylate 78:22 | 9.80 | 98.0 | 0.12 | 5.1 | 5.8 | 34500 |
| Toner 41 | block polymer 1 | 1.0 | Styrene:n-butyl acrylate 78:22 | 9.80 | 99.0 | 0.12 | 5.1 | 5.6 | 33800 |
| Toner 42 | block polymer 27 | 35.0 | Styrene:n-butyl acrylate 78:22 | 9.80 | 65.0 | 0.14 | 4.8 | 5.7 | 33200 |
| Toner 43 | block polymer 28 | 35.0 | Styrene:n-butyl acrylate 78:22 | 9.80 | 65.0 | 0.15 | 4.9 | 5.8 | 32300 |
| Toner 44 | block polymer 29 | 35.0 | Styrene:n-butyl acrylate 78:22 | 9.80 | 65.0 | 0.06 | 5.2 | 6 | 32500 |
| Toner 45 | block polymer 30 | 35.0 | Styrene:n-butyl acrylate 78:22 | 9.80 | 65.0 | 0.06 | 4.8 | 5.8 | 33800 |

<Image Evaluation>

Images were evaluated by partially modifying a commercially available color laser printer (HP Color LaserJet 3525dn). The printer was modified so as to operate with a process cartridge of only one color installed. In addition, the printer was also modified so as to allow the fixing unit to be changed to an arbitrary temperature.

Toner was removed from the black toner process cartridge installed in this color laser printer, and after cleaning the inside with an air blower, each toner (300 g) was filled into the process cartridge and the process cartridge for which toner had been replaced was installed in the color laser printer followed by carrying out the image evaluations indicated below. The specific image evaluation parameters are as indicated below.

[Low-Temperature Fixability]

Solid images (toner mounting amount: 0.9 $mg/cm^2$) were printed onto a transfer material while changing the fixation temperature and evaluated according to the criteria indicated below. Furthermore, the fixation temperature is the value determined by measuring the surface of the fixing roller using a non-contact temperature indicator. Letter-size ordinary-quality paper (Xerox 4200, Xerox Corp., 75 $g/m^2$) was used for the transfer material.

(Evaluation Criteria)

A: No offset at 100° C.

B: Occurrence of offset at 100° C.

C: Occurrence of offset at 110° C.

D: Occurrence of offset at 120° C.

[High-Temperature Fixability]

Solid images (toner mounting amount: 0.9 $mg/cm^2$) were printed onto a transfer material while changing the fixation temperature (200° C. to 220° C.) and evaluated according to the criteria indicated below. Furthermore, the fixation temperature is the value determined by measuring the surface of the fixing roller using a non-contact temperature indicator. Letter-size ordinary-quality paper (Xerox 4200, Xerox Corp., 75 g/m$^2$) was used for the transfer material.

(Evaluation Criteria)

A: No offset at 210° C.

B: Occurrence of offset at 210° C.

C: Occurrence of offset at 200° C.

D: Occurrence of offset at 190° C.

[Gloss]

Solid images (toner mounting amount: 0.6 mg/cm$^2$) were printed at a fixation temperature of 170° C. followed by measurement of gloss value using PG-3D (Nippon Denshoku Industries Co., Ltd.). Letter-size ordinary-quality paper (Xerox 4200, Xerox Corp., 75 g/m$^2$) was used for the transfer material.

(Evaluation Criteria)

A: Gloss value of 30 or higher

B: Gloss value of 20 to less than 30

C: Gloss value of 15 to less than 20

D: Gloss value of less than 15

[Development Streaks]

After finishing printing out 25,000 images with horizontal lines at a coverage rate of 1% in a normal temperature and normal humidity environment (temperature: 23° C., humidity: 60% RH) and high-temperature, high-humidity environment (temperature: 33° C., humidity: 85% RH), half-tone images (toner mounting amount: 0.6 mg/cm$^2$) were printed out on letter-size Xerox 4200 paper (Xerox Corp., 75 g/m$^2$) followed by evaluation of development streaks.

(Evaluation Criteria)

A: Not present

B: Occurrence of development streaks at 1 to 3 locations

C: Occurrence of development streaks at 4 to 6 locations

D: Occurrence of development streaks at 7 locations or more or occurrence at a width of 0.5 mm or more

[Fogging]

After finishing printing out 25,000 images with horizontal lines at a coverage rate of 1% in a normal temperature and normal humidity environment (temperature: 23° C., humidity: 60% RH) and high-temperature, high-humidity environment (temperature: 33° C., humidity: 85% RH), reflectance (%) of the non-image areas of the printed images was measured with a Model TC-6DS Reflectometer (Tokyo Denshoku Co., Ltd.) after allowing to stand for 48 hours. Fogging was evaluated using the value (%) obtained by subtracting the resulting reflectance from the reflectance (%) of unused printing paper (standard paper) measured in the same manner. A smaller value indicates greater inhibition of image fogging. Evaluations were carried out using ordinary paper (200 g HP Brochure Paper, Glossy, Hewlett-Packard Co., 200 g/m$^2$) in the glossy paper mode.

(Evaluation Criteria)

A: Less than 0.5%

B: 0.5% to less than 1.5%

C: 1.5% to less than 3.0%

D: 3.0% or more

[Blocking]

5 g aliquots of toner were placed in a 50 cc plastic cup followed by allowing to stand for 3 days at a temperature of 55° C. and humidity of 10% RH, investigating for the presence or absence of aggregates and evaluating according to the criteria indicated below.

(Evaluation Criteria)

A: Aggregates not formed

B: Minor formation of aggregates but broken up by gently pressing with the fingers C: Formation of aggregates that are unable to be broken up by gently pressing with the fingers D: Completely aggregated

EXAMPLES 1-39

In Examples 1 to 39, the above-mentioned evaluations were carried out respectively using Toners 1 to 33 and 40 to 45 as toner. The evaluation results are shown in Table 5.

COMPARATIVE EXAMPLES 1-6

In Comparative Examples 1 to 6, the above-mentioned evaluations were carried out respectively using Toners 34 to 39 as toner. The evaluation results are shown in Table 5.

TABLE 5

| | | | | | | Streaks | | Fogging | |
|---|---|---|---|---|---|---|---|---|---|
| | | Blocking 55° C. | Low-temperature fixability | High-temperature fixability | Gloss | Normal temperature/ normal humidity | High-temperature/ high-humidity | Normal temperature/ normal humidity | High-temperature/ high-humidity |
| Example 1 | Toner 1 | A | A | A | A (35) | A (0) | A(0) | A (0.3) | A (0.2) |
| Example 2 | Toner 2 | A | A | A | A (34) | A (0) | A (0) | A (0.1) | A (0.3) |
| Example 3 | Toner 3 | A | A | A | A (36) | A (0) | A (0) | A (0.2) | A (0.3) |
| Example 4 | Toner 4 | A | A | A | A (31) | A (0) | A (0) | A (0.3) | A (0.3) |
| Example 5 | Toner 5 | A | B (100) | B (210) | B (28) | A (0) | A (0) | A (0.3) | A (0.3) |
| Example 6 | Toner 6 | B | A | A | A (41) | A (0) | B (1) | A (0.3) | A (0.4) |
| Example 7 | Toner 7 | A | C (110) | B (210) | C (18) | A (0) | A (0) | A (0.3) | A (0.3) |
| Example 8 | Toner 8 | C | A | A | A (42) | C (4) | C (4) | B (0.8) | C (1.7) |
| Example 9 | Toner 9 | A | A | A | A (33) | A (0) | A (0) | A (0.2) | A (0.3) |
| Example 10 | Toner 10 | A | A | A | A (36) | A (0) | A (0) | A (0.1) | A (0.3) |
| Example 11 | Toner 11 | A | B (100) | A | B (29) | A (0) | A (0) | A (0.2) | A (0.3) |
| Example 12 | Toner 12 | B | B (100) | A | A (36) | A (0) | B (1) | A (0.2) | A (0.4) |
| Example 13 | Toner 13 | B | A | A | A (35) | A (0) | A (0) | A (0.2) | A (0.3) |
| Example 14 | Toner 14 | A | A | A | A (30) | A (0) | A (0) | A (0.1) | A (0.2) |
| Example 15 | Toner 15 | C | B (100) | A | A (35) | A (0) | B (2) | A (0.3) | A (0.3) |
| Example 16 | Toner 16 | A | B (100) | B (210) | B (27) | A (0) | A (0) | A (0.3) | A (0.3) |
| Example 17 | Toner 17 | C | B (100) | A | A (34) | B (1) | B (3) | A (0.3) | A (0.4) |
| Example 18 | Toner 18 | A | C (110) | B (210) | B (23) | A (0) | A (0) | A (0.3) | A (0.3) |
| Example 19 | Toner 19 | A | A | A | A (35) | A (0) | A (0) | A (0.2) | A (0.3) |
| Example 20 | Toner 20 | A | A | A | A (34) | A (0) | A (0) | A (0.1) | A (0.2) |
| Example 21 | Toner 21 | A | B (100) | B (205) | A (35) | A (0) | A (0) | A (0.1) | A (0.1) |

TABLE 5-continued

| | | | | | | Streaks | | Fogging | |
|---|---|---|---|---|---|---|---|---|---|
| | | Blocking 55° C. | Low-temperature fixability | High-temperature fixability | Gloss | Normal temperature/normal humidity | High-temperature/high-humidity | Normal temperature/normal humidity | High-temperature/high-humidity |
| Example 22 | Toner 22 | A | A | A | B (23) | A (0) | B (3) | A (0.3) | A (0.4) |
| Example 23 | Toner 23 | A | A | A | A (35) | A (0) | A (0) | A (0.2) | A (0.3) |
| Example 24 | Toner 24 | A | A | A | A (34) | A (0) | A (0) | A (0.1) | A (0.2) |
| Example 25 | Toner 25 | C | A | A | A (35) | B (1) | C (5) | B (0.6) | B (0.9) |
| Example 26 | Toner 26 | A | C (110) | A | A (37) | A (0) | A (0) | A (0.2) | A (0.3) |
| Example 27 | Toner 27 | A | A | A | A (33) | A (0) | A (0) | A (0.1) | B (0.7) |
| Example 28 | Toner 28 | A | A | A | A (34) | A (0) | A (0) | A (0.2) | A (0.2) |
| Example 29 | Toner 29 | C | A | A | A (37) | B (2) | C (6) | A (0.1) | A (0.2) |
| Example 30 | Toner 30 | A | C (110) | A | A (32) | A (0) | A (0) | A (0.2) | A (0.3) |
| Example 31 | Toner 31 | A | A | A | A (35) | A (0) | B (1) | A (0.3) | A (0.2) |
| Example 32 | Toner 32 | A | A | A | A (34) | B (1) | B (1) | A (0.1) | A (0.3) |
| Example 33 | Toner 33 | B | A | A | A (36) | A (0) | B (2) | B (0.6) | B (1.4) |
| Comparative Example 1 | Toner 34 | D | A | D | A (33) | B (2) | C (4) | D (3.1) | D (4.4) |
| Comparative Example 2 | Toner 35 | A | D | A | B (27) | A (0) | A (0) | A (0.2) | A (0.3) |
| Comparative Example 3 | Toner 36 | D | D | B (210) | A (38) | D (10) | D (3 mm) | A (0.2) | C (1.6) |
| Comparative Example 4 | Toner 37 | A | D | A | B (29) | A (0) | A (0) | A (0.1) | A (0.2) |
| Comparative Example 5 | Toner 38 | D | D | B (205) | A (35) | C (4) | D (10) | D (3.2) | D (5.8) |
| Comparative Example 6 | Toner 39 | D | D | D | D (14) | C (4) | C (6) | A (0.2) | A (0.3) |
| Example 34 | Toner 40 | A | C (110) | B (210) | C (18) | A (0) | A (0) | A (0.3) | A (0.3) |
| Example 35 | Toner 41 | A | C (115) | B (205) | C (18) | A (0) | A (0) | A (0.3) | A (0.3) |
| Example 36 | Toner 42 | B | B (100) | A | A (38) | A (0) | B (3) | A (0.2) | A (0.4) |
| Example 37 | Toner 43 | C | B (105) | A | A (39) | B (1) | C (5) | A (0.2) | A (0.4) |
| Example 38 | Toner 44 | C | B (100) | A | A (34) | B (1) | B (3) | A (0.3) | A (0.4) |
| Example 39 | Toner 45 | C | B (100) | A | A (34) | B (2) | C (5) | A (0.3) | A (0.4) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-247684, filed Nov. 29, 2013, which is hereby incorporated by reference herein in its entirety.

What is claimed is:

1. A toner having a toner particle comprising a binder resin, said binder resin comprising a styrene acrylic resin and a linear block polymer, wherein the block polymer has a polyester segment and a vinyl polymer segment, the melting point (Tm) of the block polymer is 55° C. to 90° C., the polyester segment has at least two structures selected from structures represented by the following formulas (1) to (3), or a structure represented by the following formula (3), the solubility parameter (SP) value of the polyester segment is 9.40 to 9.85, and the weight-average molecular weight (Mw) of the vinyl polymer segment is 4000 to 15000:

(1)

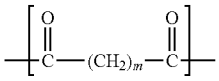

(m represents an integer of 6 to 14), (2)

(n represents an integer of 6 to 16), and (3)

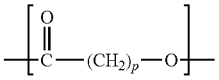

(p represents an integer of 5 to 15).

2. The toner according to claim 1, wherein the polyester segment has a structure represented by the formula (1) and a structure represented by the formula (2).

3. The toner according to claim 1, wherein the content of the block polymer in the binder resin is 2.0% by mass to 50.0% by mass.

4. The toner according to claim 3, wherein the content of the block polymer in the binder resin is 6.0% by mass to 50.0% by mass.

5. The toner according to claim 1, wherein the ratio (C/A ratio) of the polyester segment to the vinyl polymer segment is 40:60 to 80:20.

6. The toner according to claim 5, wherein the ratio (C/A ratio) of the polyester segment to the vinyl polymer segment is 40:60 to 70:30.

7. The toner according to claim 1, wherein the weight-average molecular weight (Mw) of the block polymer is 15000 to 45000.

8. The toner according to claim 7, wherein the weight-average molecular weight (Mw) of the block polymer is 20000 to 45000.

9. The toner according to claim 1, wherein the ratio (Mw/Mn) of the weight-average molecular weight (Mw) to the number average molecular weight (Mn) of the block polymer is 1.5 to 3.5.

10. The toner according to claim 1, wherein the ratio (Mw/Mn) of the weight-average molecular weight (Mw) to the number average molecular weight (Mn) of the vinyl polymer segment is 1.3 to 3.5.

11. The toner according to claim 1, wherein the SP value of the styrene acrylic resin is 9.45 to 9.90.

12. The toner according to claim 1, wherein the absolute value (ΔSP value) of a difference between the solubility parameter (SP) value of the styrene acrylic resin and the SP value of the block polymer is 0.03 to 0.20.

13. The toner according to claim 1, wherein the toner particle is a toner particle produced by a suspension polymerization method.

14. A toner having a toner particle comprising a binder resin, said binder resin comprising a styrene acrylic resin and a block polymer, wherein the block polymer has a polyester segment and a vinyl polymer segment, the melting point (Tm) of the block polymer is 55° C to 90° C.

the polyester segment has at least two structures selected from structures represented by the following formulas (1) to (3), or a structure represented by the following formula (3), the solubility parameter (SP) value of the polyester segment is 9.40 to 9.85, and the weight-average molecular weight (Mw) of the vinyl polymer segment is 4000 to 15000;

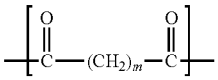

(1)

(m represents an integer of 6 to 14), (2)

(n represents an integer of 6 to 16), and

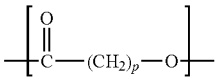

(3)

(p represents an integer of 5 to 15).

* * * * *